US008356880B2

(12) United States Patent
Hirosawa et al.

(10) Patent No.: US 8,356,880 B2
(45) Date of Patent: Jan. 22, 2013

(54) INKJET RECORDING APPARATUS AND METHOD FOR CONTROLLING IT

(75) Inventors: Susumu Hirosawa, Tokyo (JP); Yuji Kanome, Yokohama (JP); Hiroyuki Tanaka, Kawasaki (JP); Yoshiaki Suzuki, Nagareyama (JP); Masahiro Sugimoto, Yokohama (JP); Seiji Suzuki, Ebina (JP); Takeaki Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 211 days.

(21) Appl. No.: 13/033,437

(22) Filed: Feb. 23, 2011

(65) Prior Publication Data

US 2011/0211018 A1 Sep. 1, 2011

(30) Foreign Application Priority Data

Feb. 26, 2010 (JP) ..... 2010-042350

(51) Int. Cl.
*B41J 2/165* (2006.01)

(52) U.S. Cl. ..... 347/30

(58) Field of Classification Search ..... 347/23, 347/29, 30, 33, 35
See application file for complete search history.

(56) References Cited

U.S. PATENT DOCUMENTS 7,014,292 B2 * 3/2006 Yazawa et al. ..... 347/29
7,029,092 B2 * 4/2006 Edamura et al. ..... 347/30
7,240,983 B2 * 7/2007 Kojima ..... 347/23

FOREIGN PATENT DOCUMENTS

JP 11-10908 A 1/1999

* cited by examiner

*Primary Examiner* — Lamson Nguyen
(74) *Attorney, Agent, or Firm* — Canon USA, Inc., IP Division

(57) ABSTRACT

In order to efficiently perform preliminary ejection of ink at a bend of an ink circulation passage, the number of preliminary ejections of a nozzle group located on the outer side of the bend is set larger than the number of preliminary ejections of a nozzle group located in the middle of the bend.

15 Claims, 14 Drawing Sheets

[CHIP 92a]

《NOZZLE》

| | | NOZZLE GROUP | | |
|---|---|---|---|---|
| | | 1 | 2 | 3 |
| NOZZLE ROW | A | 0–383 | 384–639 | 640–1023 |
| | B | 0–255 | 256–767 | 768–1023 |
| | C | 0–127 | 128–895 | 896–1023 |
| | D | – | 0–1023 | – |

[seg]

《PRELIMINARY EJECTION》

| | NOZZLE GROUP | | |
|---|---|---|---|
| | 1 | 2 | 3 |
| NOZZLE ROW | 4000 | 1000 | 4000 |

[dot]

[CHIP 92a]

《NOZZLE》

| | | NOZZLE GROUP | | |
|---|---|---|---|---|
| | | 1 | 2 | 3 |
| NOZZLE ROW | A | 0–383 | 384–639 | 640–1023 |
| | B | 0–255 | 256–767 | 768–1023 |
| | C | 0–127 | 128–895 | 896–1023 |
| | D | – | 0–1023 | – |

[seg]

《PRELIMINARY EJECTION》

| | NOZZLE GROUP | | |
|---|---|---|---|
| | 1 | 2 | 3 |
| NOZZLE ROW | 4000 | 1000 | 4000 |

[dot]

[CHIP 92b]

《NOZZLE》

| | | NOZZLE GROUP | | |
|---|---|---|---|---|
| | | 1 | 2 | 3 |
| NOZZLE ROW | A | – | 0–1023 | – |
| | B | 0–127 | 128–895 | 896–1023 |
| | C | 0–255 | 256–767 | 768–1023 |
| | D | 0–383 | 384–639 | 640–1023 |

[seg]

《PRELIMINARY EJECTION》

| | NOZZLE GROUP | | |
|---|---|---|---|
| | 1 | 2 | 3 |
| NOZZLE ROW | 4000 | 1000 | 4000 |

[dot]

FIG. 13A

《PRELIMINARY EJECTION》

| | | NOZZLE GROUP | | |
|---|---|---|---|---|
| | | 1 | 2 | 3 |
| RECORDING TIME [min] | 0–5 | 1000 | 1000 | 1000 |
| | 5–10 | 2000 | 1000 | 2000 |
| | 10–20 | 3000 | 1000 | 3000 |
| | 20– | 4000 | 1000 | 4000 |

[dot]

FIG. 13B

《PRELIMINARY EJECTION》

| | NOZZLE GROUP | | |
|---|---|---|---|
| | 1 | 2 | 3 |
| NOZZLE ROW | 7200 | 3600 | 7200 |

[Hz]

FIG. 13C

《PRELIMINARY EJECTION》

| | | NOZZLE GROUP | | |
|---|---|---|---|---|
| | | 1 | 2 | 3 |
| RECORDING TIME [min] | 0–5 | 3600 | 3600 | 3600 |
| | 5–10 | 4800 | 3600 | 4800 |
| | 10–20 | 6000 | 3600 | 6000 |
| | 20– | 7200 | 3600 | 7200 |

[Hz]

《PRELIMINARY EJECTION》

| | NOZZLE GROUP | | |
|---|---|---|---|
| | 1 | 2 | 3 |
| NOZZLE ROW | PWM3 | PWM0 | PWM3 |

《PRELIMINARY EJECTION》

| | | NOZZLE GROUP | | |
|---|---|---|---|---|
| | | 1 | 2 | 3 |
| RECORDING TIME [min] | 0–5 | PWM0 | PWM0 | PWM0 |
| | 5–10 | PWM1 | PWM0 | PWM1 |
| | 10–20 | PWM2 | PWM0 | PWM2 |
| | 20– | PWM3 | PWM0 | PWM3 |

INKJET RECORDING APPARATUS AND METHOD FOR CONTROLLING IT

BACKGROUND OF THE INVENTION

1. Field of the Invention

The present invention relates to an inkjet recording apparatus that performs recording using a recording head for ejecting ink, and a method for controlling it.

2. Description of the Related Art

When nozzles of an inkjet recording apparatus have not ejected ink for a long time, water evaporates not only from the mouths of the nozzles but also from liquid chambers at the backs of the nozzles, and thickened ink occupies the insides of the nozzles. If an image is recorded in this state, the thickened ink may cause an image defect. In order to prevent ejection defects of nozzles or thickening of ink due to water evaporation from nozzles, preliminary ejection is performed. For example, in an apparatus that uses a line head as a recording head and performs prolonged continuous recording on roll paper, preliminary ejection is performed onto a recording medium (roll paper) between image recording operations.

Japanese Patent Laid-Open No. 11-10908 discloses a technique in which ink is circulated along an ink passage in a recording head and the amount of ink to be circulated is varied according to the temperature of the recording head. By circulating ink, a constant ink temperature in the recording head can be maintained, and thickened ink in the liquid chambers at the backs of the nozzles is diffused.

However, even if ink is circulated in the recording head, preliminary ejection is necessary to prevent image defects due to thickening of ink. At each bend of the ink circulation passage, the outer side of the bend is inefficient in diffusion and movement of ink compared to the middle of the bend. Therefore, during preliminary ejection, thickened ink tends to remain on the outer side of the bend.

SUMMARY OF THE INVENTION

In an aspect of the present invention, an inkjet recording apparatus that records an image on a recording medium using a recording head having a plurality of nozzle rows in which nozzles for ejecting ink are arranged includes an ink passage for supplying ink to the plurality of nozzle rows, a circulation unit configured to circulate ink in the ink passage, and a preliminary ejection unit configured to preliminarily eject ink from the plurality of nozzle rows. The preliminary ejection unit preliminarily ejects ink from the plurality of nozzle rows in such a manner that the amount of ink preliminarily ejected from a nozzle group located on the outer side of a bend of the ink passage is larger than the amount of ink preliminarily ejected from a nozzle group located in the middle of the bend of the ink passage.

In another aspect of the present invention, an inkjet recording apparatus records an image on a recording medium using a recording head having a first nozzle row and a second nozzle row in which nozzles for ejecting ink are arranged in a predetermined direction. The first nozzle row and the second nozzle row are staggered in the predetermined direction and a direction perpendicular to the predetermined direction. The apparatus includes a circulation unit configured to cause ink to flow in one direction of an ink passage corresponding to the first nozzle row and the second nozzle row and connecting a first end in the predetermined direction of the first nozzle row and a second end in the predetermined direction of the second nozzle row and to thereby circulate ink supplied to the nozzles and; and a preliminary ejection unit configured to preliminarily eject ink from the first nozzle row and the second nozzle row. The preliminary ejection unit preliminarily ejects ink from the first nozzle row and the second nozzle row in such a manner that the amount of ink preliminarily ejected from a nozzle group including at least a nozzle at the first end and the amount of ink preliminarily ejected from a nozzle group including at least a nozzle at the second end are each larger than the amount of ink preliminarily ejected from the other nozzle group.

Another aspect of the present invention provides a method for controlling an inkjet recording apparatus that records an image on a recording medium using a recording head having a first nozzle row and a second nozzle row in which nozzles for ejecting ink are arranged in a predetermined direction. The first nozzle row and the second nozzle row are staggered in the predetermined direction and a direction perpendicular to the predetermined direction. The method includes a circulation step of causing ink to flow in one direction of an ink passage corresponding to the first nozzle row and the second nozzle row and connecting a first end in the predetermined direction of the first nozzle row and a second end in the predetermined direction of the second nozzle row and thereby circulating ink supplied to the nozzles; and a preliminary ejection step of preliminarily ejecting ink from the first nozzle row and the second nozzle row. In the preliminary ejection step, ink is preliminarily ejected from the first nozzle row and the second nozzle row in such a manner that the amount of ink preliminarily ejected from a nozzle group including at least a nozzle at the first end and the amount of ink preliminarily ejected from a nozzle group including at least a nozzle at the second end are each larger than the amount of ink preliminarily ejected from the other nozzle group.

The present invention can efficiently discharge thickened ink at a bend of an ink circulation passage.

Further features of the present invention will become apparent from the following description of exemplary embodiments with reference to the attached drawings.

BRIEF DESCRIPTION OF THE DRAWINGS

FIGS. 13A to 13C show the number of preliminary ejections varied according to the recording time or the drive frequency of each nozzle group.

DESCRIPTION OF THE EMBODIMENTS

First Embodiment

Figure 1:
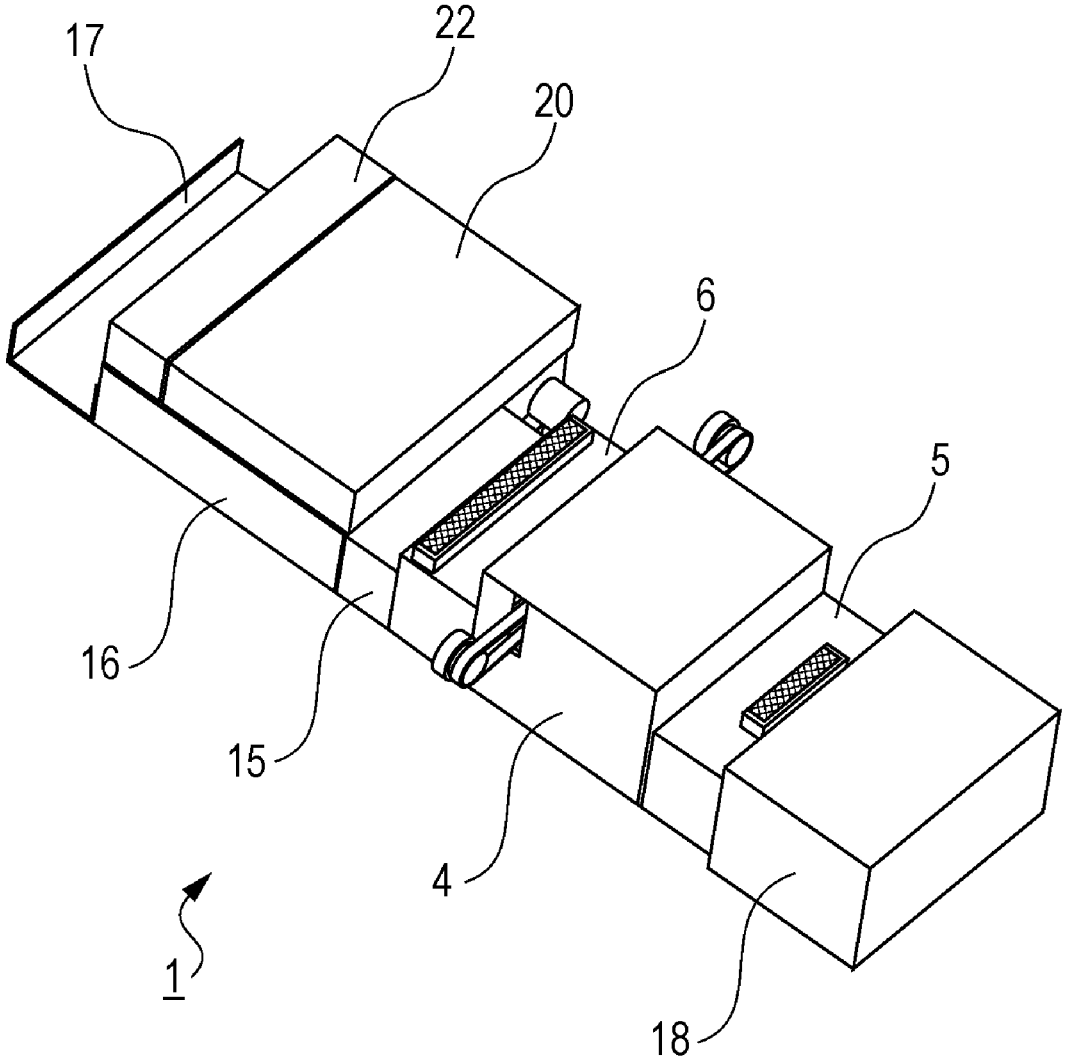
FIG. 1 is a schematic perspective view of an inkjet recording apparatus.
Figure 2:
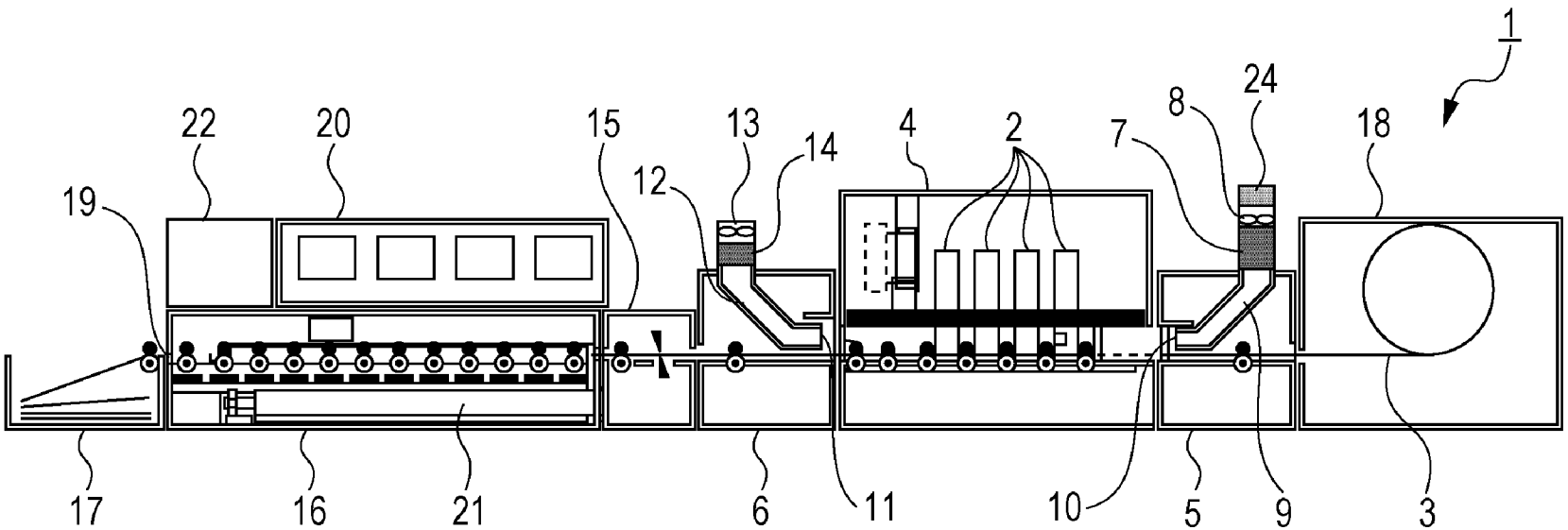
FIG. 2 is a schematic sectional view of the inkjet recording apparatus.

Embodiments of the present invention will now be described in detail with reference to the drawings. FIG. 1 shows a perspective view of an inkjet recording apparatus (hereinafter also simply referred to as "recording apparatus") to which the present invention is applicable. FIG. 2 schematically shows the cross-section structure of FIG. 1.

As shown in FIGS. 1 and 2, the recording apparatus 1 is provided with a plurality of recording heads 2 corresponding to ink colors. By ejecting ink from the recording heads 2 onto a recording medium 3, an image is formed on the recording medium 3. At the most upstream position of the recording apparatus 1, a paper feed unit 18 is located in which the recording medium 3 in a rolled state is loaded, and a paper feed mechanism (not shown) is provided that conveys the recording medium 3 to the recording heads 2 and feeds the recording medium 3 at a predetermined speed during a recording operation. A recording unit 4 houses the recording heads 2. An airflow supply unit 5 and an airflow recovery unit 6 disposed adjacent to the recording unit 4 regulate the humidity near the nozzle surfaces of the recording heads 2.

A supply duct 9 in the airflow supply unit 5 is fixed at a given distance above the recording medium 3. A supply port 10 faces a given gap provided between the recording heads 2 and the recording medium 3. A humidified airflow into the supply duct 9 is produced by a supply filter 24, a supply fan 8, and a steam generator 7. Near the supply port 10 and the nozzle surfaces of the recording heads 2, humidity sensors (not shown) for measuring the humidity are disposed. A suction duct 12 in the airflow recovery unit 6 is fixed at a given distance above the recording medium 3 like the supply duct 9. A suction port 11 faces the given gap provided between the recording heads 2 and the recording medium 3. In the suction duct 12 are disposed a suction fan 13 and a suction filter 14. The humidified airflow supplied to the vicinities of the nozzle surfaces of the recording heads 2 is sucked in by the suction fan 13 through the suction port 11, passes through the suction duct 12, then passes through the suction filter 14 where ink mist generated during a recording operation is recovered, and is discharged from the airflow recovery unit 6.

The recording medium 3 is conveyed along a conveying direction B. A recording operation is performed in the recording unit 4. After undergoing the recording operation, the recording medium 3 is cut into pieces having a predetermined length in a cutter unit 15. The cut pieces are conveyed to a drying unit 16. The ink on the cut pieces is dried in the drying unit 6. After dried, the cut pieces are ejected through the exit 19 of the drying unit 16 and stacked in a stacker 17. An ink tank unit 20 supplies inks to the recording heads 2 through tubes (not shown) or the like. The recording apparatus 1 is provided with a control unit that controls the recording heads 2, the paper feed/conveying mechanism, the paper ejection mechanism, and other units. The recording apparatus 1 is also provided with a power supply unit 22 that supplies electric energy to a drive unit (not shown), the recording heads 2, or a heater 21.

Figure 3:
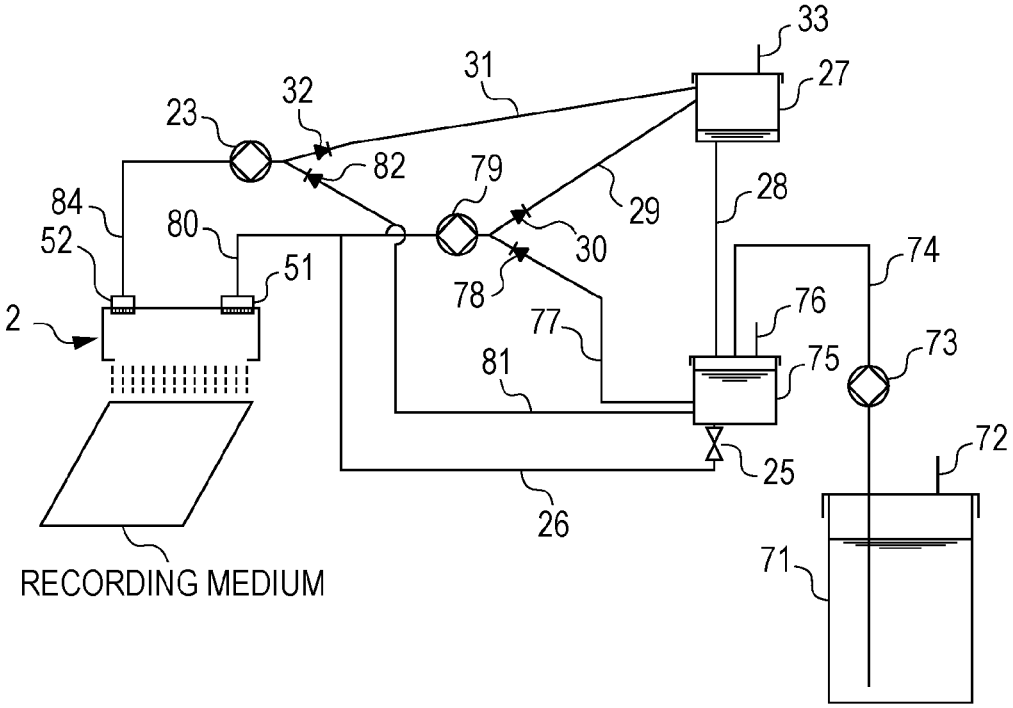
FIG. 3 is a schematic view of a circulation unit of the inkjet recording apparatus.

Next, the configuration of ink passages will be described with reference to FIG. 3. A replaceable ink cartridge 71 has an atmosphere communication port 72 in communication with the atmosphere. To the ink cartridge 71 is connected one end of an ink passage 74 that passes through an ink supply pump 73. The other end of the ink passage 74 is connected to a subtank 75. By driving the ink supply pump 73, ink can be supplied from the ink cartridge 71 to the subtank 75 as needed.

The subtank 75 has an atmosphere communication port 76 in communication with the atmosphere. To the subtank 75 are connected ink passages 77 and 81. The ink passage 77 is connected to an ink passage 80 through a check valve 78 and a first ink circulation pump 79. The check valve 78 permits ink to flow through it only in a direction from the subtank 75 to a first ink port 51 of a recording head 2. The ink passage 80 is connected to the first ink port 51 of the recording head 2. The first ink circulation pump 79 is disposed at the highest position in the ink passages 77 and 80.

The ink passage 81 is connected to an ink passage 84 through a check valve 82 and a second ink circulation pump 23. The check valve 82 permits ink to flow through it only in a direction from the subtank 75 to a second ink port 52 of the recording head 2. The ink passage 84 is connected to the second ink port 52 of the recording head 2. The second ink circulation pump 23 is disposed at the highest position in the ink passages 82 and 84.

An opening and closing valve 25 is provided at the bottom of the subtank 75. To the opening and closing valve 25 is connected one end of an ink passage 26. The other end of the ink passage 26 is connected to the ink passage 80 between the first ink circulation pump 79 and the recording head 2. The subtank 75 is connected to the bottom of a buffer tank 27 by an ink passage 28.

From a part of the ink passage 77 between the first ink circulation pump 79 and the check valve 78, an ink passage 29 branches off that leads to the buffer tank 27. In a part of the ink passage 29 near the first ink circulation pump 79, a check valve 30 is provided that permits ink to flow through it only in a direction from the first ink circulation pump 79 to the buffer tank 27. From a part of the ink passage 81 between the second ink circulation pump 23 and the check valve 82, an ink passage 31 branches off that leads to the buffer tank 27. In a part of the ink passage 31 near the second ink circulation pump 23, a check valve 32 is provided that permits ink to flow through it only in a direction from the second ink circulation pump 23 to the buffer tank 27.

The buffer tank 27 has an atmosphere communication port 33 in communication with the atmosphere. The buffer tank 27 is disposed at the highest position in the ink passages 28, 29, and 31. The buffer tank 27 is disposed at a position higher than the subtank 75. Therefore, ink returned to the buffer tank 27 flows to the subtank 75 due to its own weight through the ink passage 28 connected to the bottom of the buffer tank 27.

The first ink circulation pump 79 and the second ink circulation pump 23 are tube pumps in this embodiment and can change the direction of ink flow by changing the direction of pump rotation. When stopped, the pumps block the passages. The first ink circulation pump 79 and the second ink circulation pump 23 are not limited to tube pumps and may be any type of pumps as long as they have a mechanism that can change the direction of ink flow and can stop the ink flow by controlling the pump or the passage. The ink supply pump 73 can cause ink to flow in at least one direction.

Figure 4:
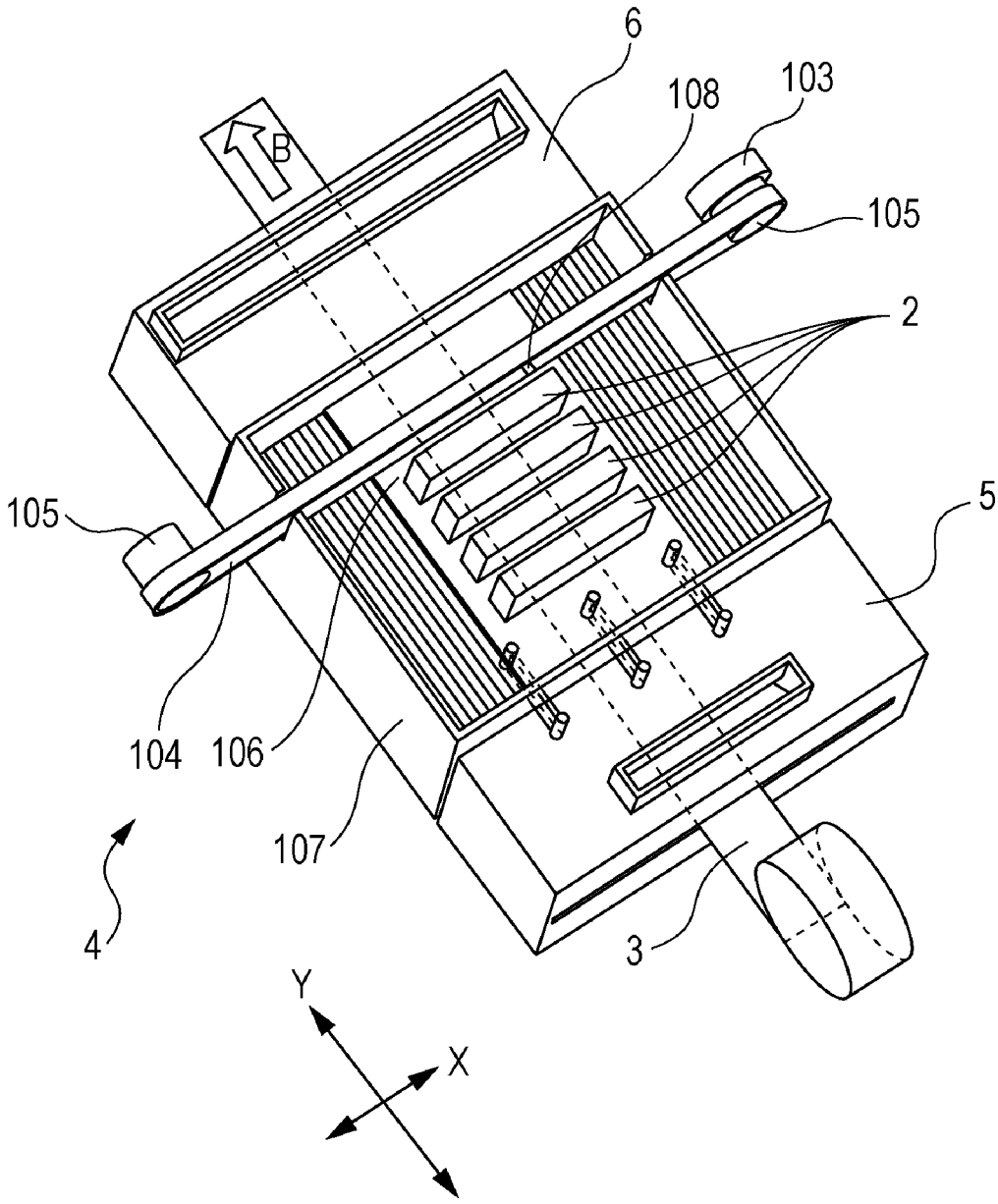
FIG. 4 is a schematic perspective view showing the configuration of the recording unit and its surrounding of the inkjet recording apparatus.

FIG. 4 is a schematic perspective view showing the configuration of the recording unit and its surrounding according to the first embodiment of the present invention. FIG. 4 shows the recording unit 4, and the airflow supply unit 5 and the airflow recovery unit 6 disposed adjacent to the recording unit 4. The recording unit 4 is a substantially closed space surrounded by a case frame 107. The recording heads 2 are attached to a holder 106. The holder 106 can be moved by a drive mechanism (not shown) in the direction of the recording surface of the recording medium 3, not only to a position where a recording operation is performed but also to a predetermined position where preliminary ejection is performed, a predetermined position where the nozzle surfaces are wiped, a predetermined position where capping is performed in order to prevent drying of the nozzle surfaces when recording is not performed, and the like.

The holder 106 can be moved relative to the recording medium 3 in a direction X substantially perpendicular to the direction in which the recording medium 3 is conveyed, in order to reduce the difference in the number of ejections between nozzles caused by the difference between the recordable width of the recording heads and the width of the recording medium 3. The holder 106 is fixed to a belt 104 with an attachment part 108. A pulley 105 attached to the belt 104 is driven by a pulse motor 103. On the basis of the size of the recording medium 3 obtained from an external information terminal (not shown) and the accumulated number of ejections of the recording heads 2, the pulse motor 103 performs pulse control and moves the holder 106 during recording so that the numbers of ejections of the nozzles disposed in the recording heads 2 are equalized. The holder 106 is then fixed to an appropriate position by a fixing mechanism (not shown).

Figure 5:
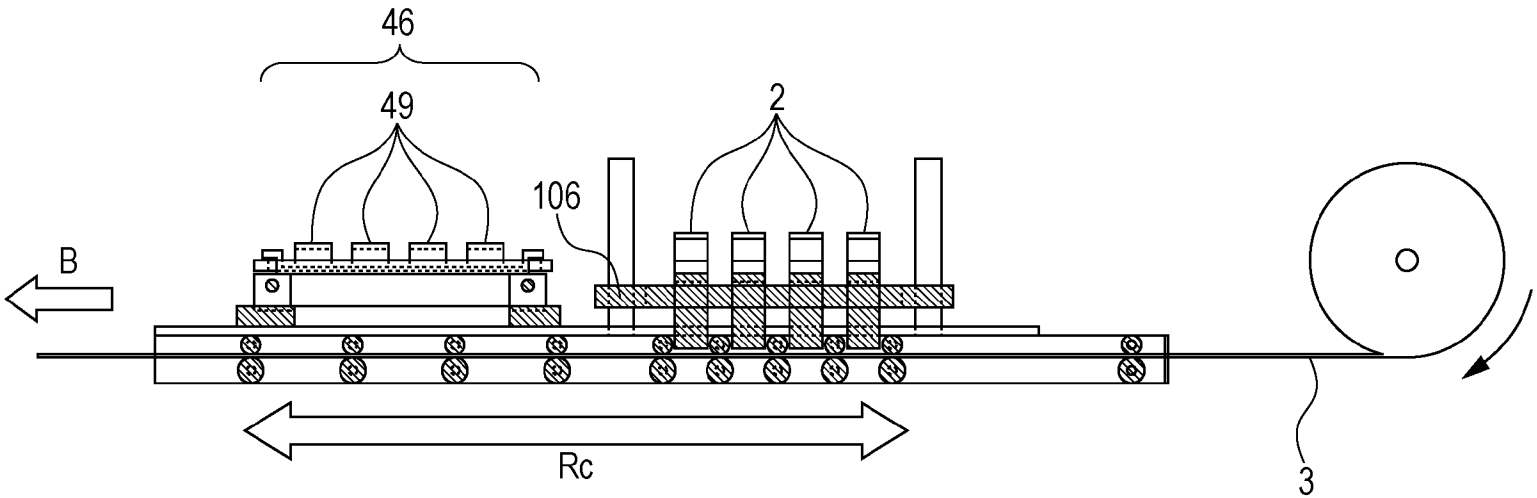
FIG. 5 is a schematic sectional view of the inkjet recording apparatus during recording.
Figure 6:
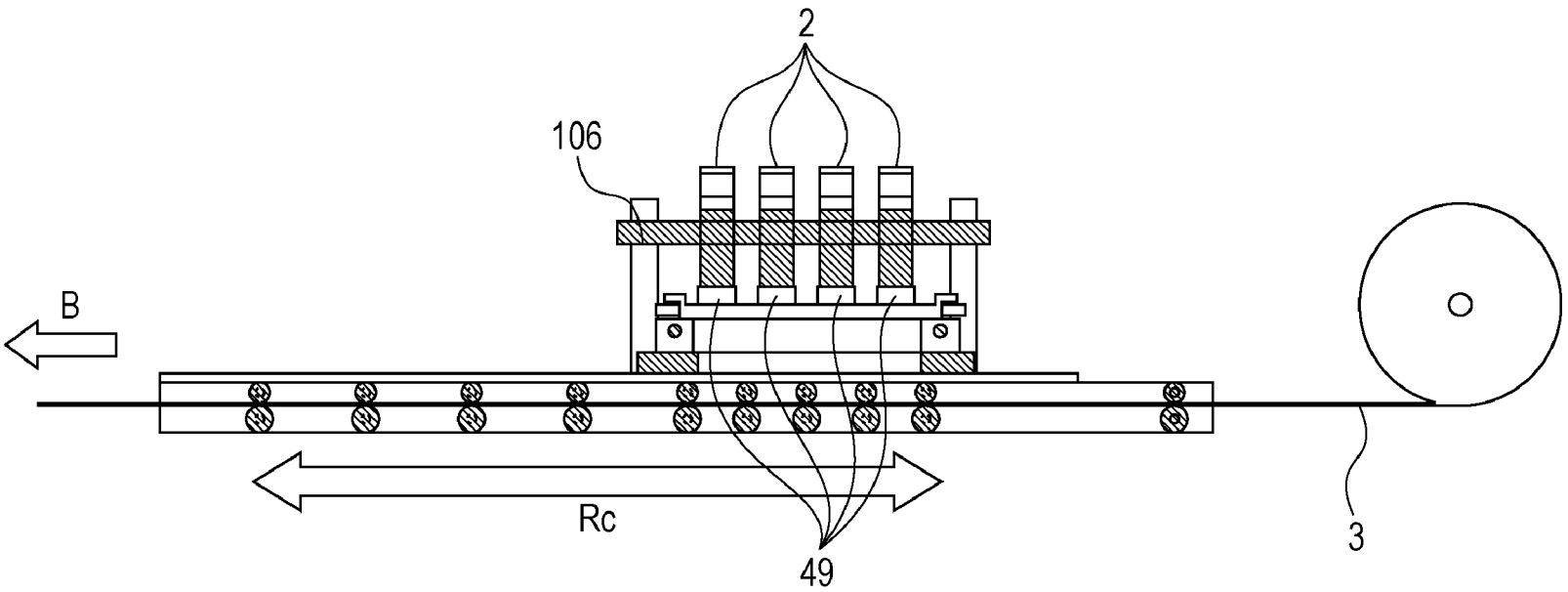
FIG. 6 is a schematic sectional view of the inkjet recording apparatus during cleaning and preliminary ejection.

FIG. 5 is a sectional view showing the cross-sectional structure of FIG. 4. FIG. 6 is a sectional view showing the state during a cleaning operation. The recording apparatus has a plurality of recording heads 2 corresponding to different ink colors. Although the recording apparatus has four recording heads 2 corresponding to four colors of CMYK in this embodiment, the number of colors is not limited to four. Each color of ink is supplied from an ink tank through an ink tube to the corresponding recording head 2. The plurality of recording heads 2 are integrally held by the holder 106. The holder 106 can be moved up and down by a mechanism (not shown) so that the distance between the plurality of recording heads 2 and the surface of the recording medium 3 can be changed.

A cap unit 46 has a plurality of (four in this embodiment) cleaning mechanisms 49 corresponding to a plurality of (four in this embodiment) recording heads 2. The cap unit 46 can slide in a first direction. The cap unit 46 is provided with caps and in-cap absorbers and can hold ink ejected from nozzles, for example, in preliminary ejection. FIG. 5 shows the state during recording, where the cap unit 46 is located downstream, in the recording medium conveying direction, relative to the recording unit. FIG. 6 shows the state during cleaning and preliminary ejection, where the cap unit 46 is located immediately below the recording heads 2 of the recording unit. In FIGS. 5 and 6, the range of movement of the cap unit 46 is indicated by an arrow Rc.

Figure 7:
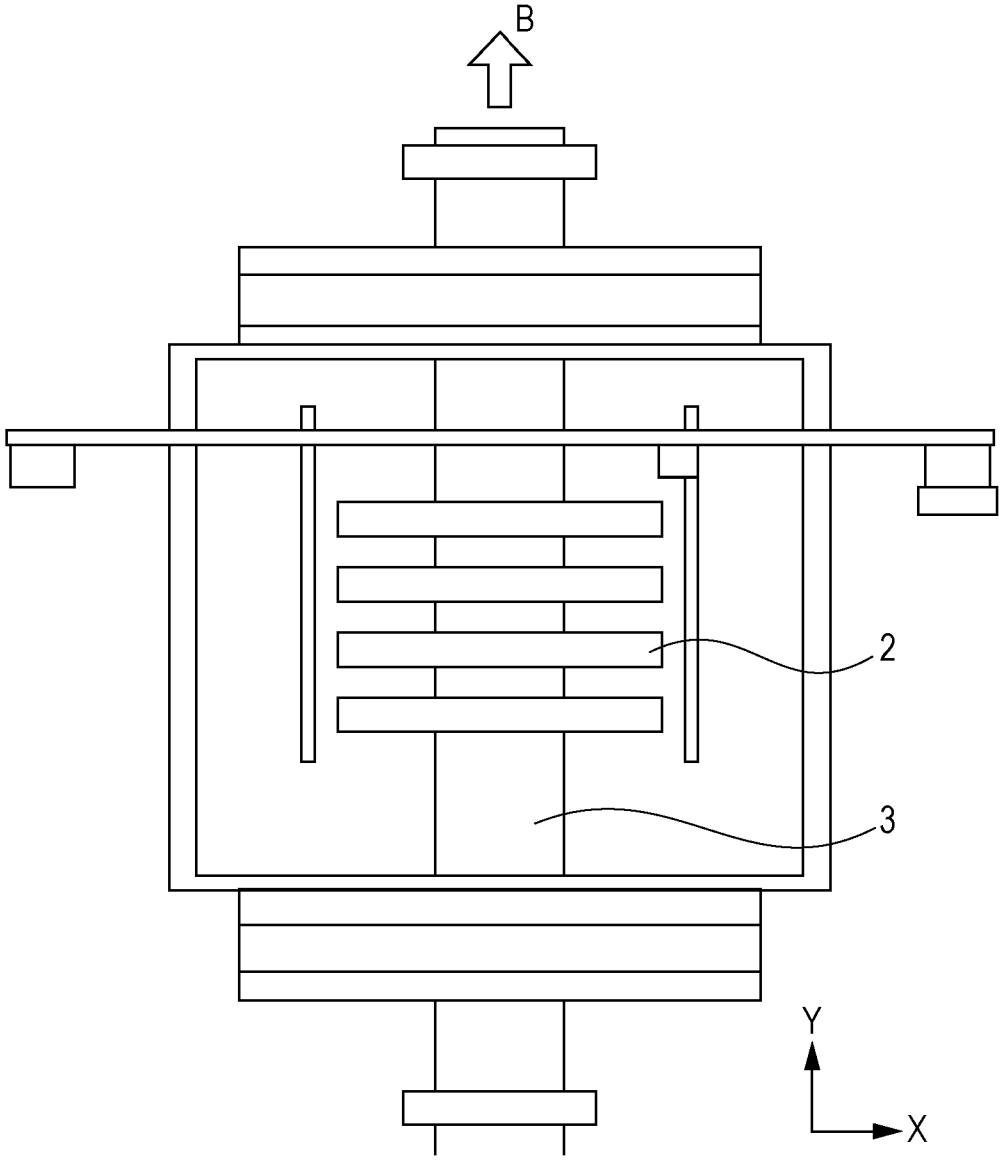
FIG. 7 is a plan view of the inkjet recording apparatus.

FIG. 7 is a plan view showing the outline of the configuration of an inkjet recording apparatus that is a typical embodiment of the present invention. As shown in FIG. 7, recording heads 2 are attached to the center of the main body, and a recording medium 3 on which recording is performed by the recording heads 2 is conveyed in the inkjet recording apparatus independently of the width of the recording heads 2. The recording heads 2 are 12 inches in width. Various widths of recording media can be conveyed as long as recording can be performed thereon by the recording heads 2.

Figure 8:
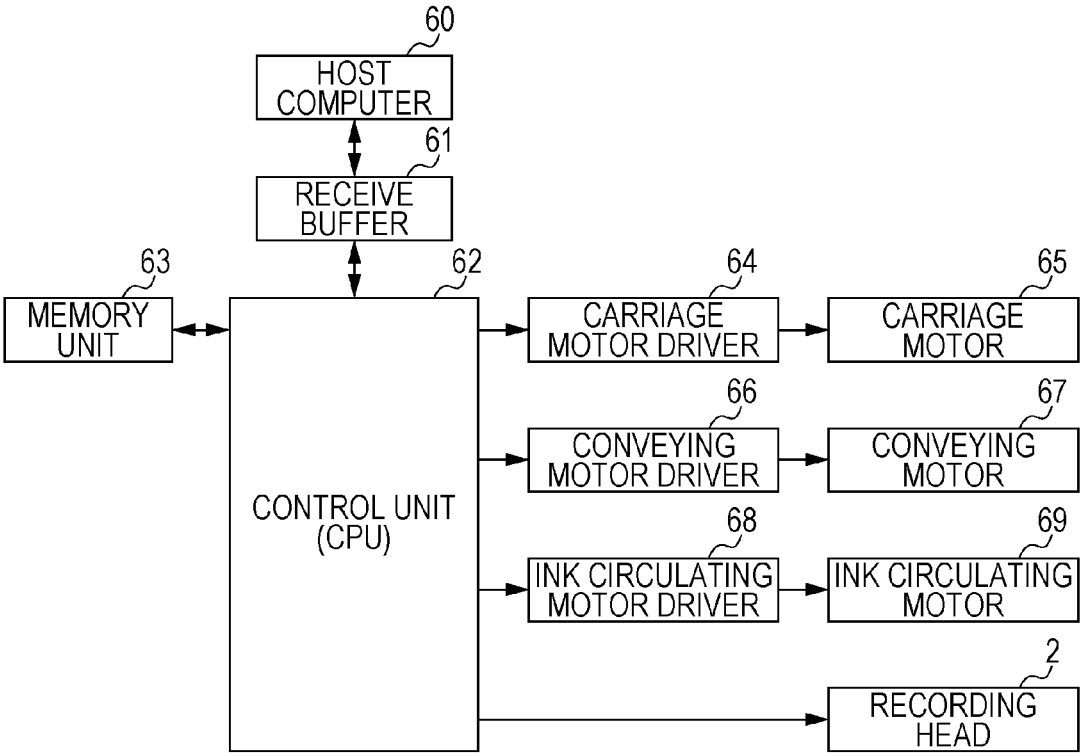
FIG. 8 is a block diagram of a control system of the inkjet recording apparatus.

FIG. 8 shows a block diagram of a control system used in the above-described inkjet recording apparatus. From a host computer 60, data of characters and/or images to be recorded are input into a receive buffer 61 of the inkjet recording apparatus. Data indicating whether data are being correctly transferred, and data indicating the operating state of the inkjet recording apparatus are output from the inkjet recording apparatus to the host computer 60. Data in the receive buffer 61 are transferred to a memory unit 63 and temporarily stored in a RAM (Random Access Memory) of the memory unit 63 under the control of the control unit (CPU: Central Processing Unit) 62. In a ROM of the memory unit 63 is stored a program for performing the ejection recovery control of the recording heads to be described later. On the basis of this program, the CPU 62 controls the recording heads 2 and others and causes them to perform the ejection recovery control.

A carriage motor driver 64 drives a carriage motor 65 by a command from the CPU 62. A conveying motor driver 66 controls a conveying motor 67 by a command from the CPU 62. The conveying motor 67 conveys the recording medium 3. An ink circulating motor driver 68 controls an ink circulating motor 69 by a command from the CPU 62. The ink circulating motor 69 drives the circulation pumps and the opening and closing valve. Commands from the CPU 62 drive and control the recording heads 2 and perform image recording and preliminary ejection. Inside each recording head 2, a heater board (element substrate) is disposed that is a silicon substrate on which are integrated heat-generating resistive elements for ejecting ink droplets, electric circuitry for controlling them, and drive elements. On this heater board, a recording head temperature detection sensor is disposed that detects the temperature of the recording head 2. A sensor that uses the temperature characteristic of output voltage of an diode or a sensor that uses the temperature characteristic of resistance of an electric resistive element can be used as this detection sensor.

Figure 9:
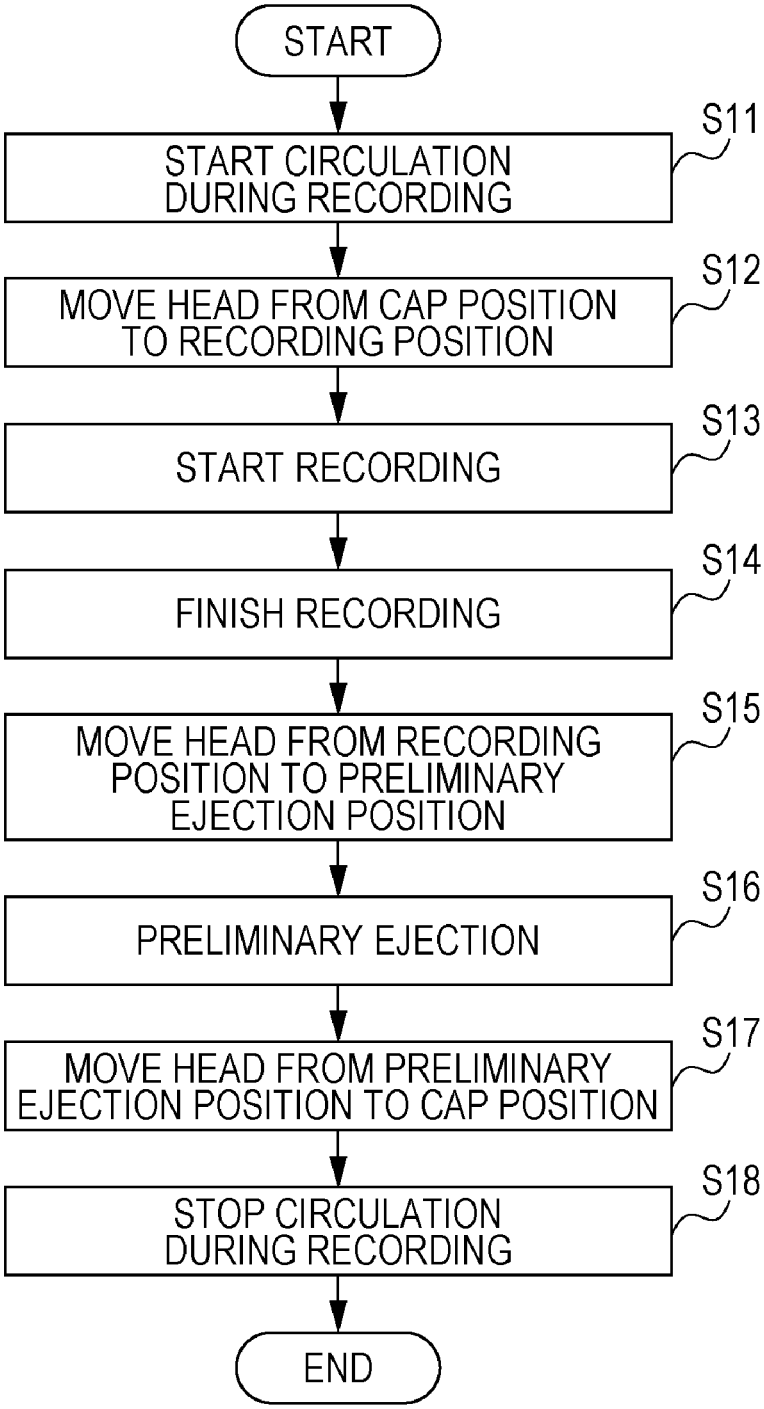
FIG. 9 is a flowchart showing a method for recovering ejection according to a first embodiment.

A description will be given of a method for recovering ejection of recording heads that is a characteristic of this embodiment. FIG. 9 is a flowchart showing the outline of a method for recovering ejection of recording heads.

First, in step S11, the ink circulating motor driver 68 controls the ink circulating motor 69 that drives the circulating pumps and the opening and closing valve, and starts the ink circulation in the recording heads 2 during recording. The ink circulation performed during recording diffuses thickened ink in the recording heads 2 and prevents the temperature increase of the recording heads 2 due to ejection. Next, in step S12, in order to receive a recording command from an operator and to start recording, the carriage motor driver 64 drives the carriage motor 65 and moves the recording heads 2 from the cap position to the recording position.

Next, in step S13, the conveying motor driver 66 controls the conveying motor 67 that conveys the recording medium 3, and the recording medium 3 is conveyed. By a command from the CPU 62, the recording heads 2 are driven and controlled, and image recording is started. The recording heads 2 are 12 inches in width, and the recording medium 3 is 6 inches in width in this embodiment. During image recording, the recording heads 2 perform preliminary ejection between image recording operations on the recording medium 3 (roll paper). However, nozzles located outside the edges of the recording medium 3 cannot perform preliminary ejection onto the recording medium 3. Such nozzles do not eject ink for a long time, and therefore ink thickened due to water evaporation occupies not only the mouths of the nozzles but also liquid chambers at the backs of the nozzles.

In step S14, the conveying motor driver 66 controls the conveying motor 67 that conveys the recording medium 3, and finishes the conveying of the recording medium 3. By a command from the CPU 62, the recording heads 2 are driven and controlled, and image recording is finished. Depending on the length of the recording medium 3 and the speed at which the recording medium 3 is conveyed, the time taken from the start of recording of step S13 to the finish of recording of step S14 is several minutes to several hours. While recording is performed, ink is not ejected from the nozzles located outside the edges of the recording medium 3. Therefore, ink thickened due to water evaporation from the nozzles accumulates.

Next, in step S15, the carriage motor driver 64 drives the carriage motor 65 and moves the recording heads 2 after finishing recording from the recording position to the preliminary ejection position. The cap unit 46 is moved to under the recording heads 2 so that the recording heads 2 can perform preliminary ejection. In step S16, the CPU 62 drives and controls the recording heads 2, and preliminary ejection is performed from the nozzles located outside the edges of the recording medium 3 into the caps. Next, in step S17, the carriage motor driver 64 drives the carriage motor 65 and moves the recording heads 2 from the preliminary ejection position to the cap position. In step S18, the ink circulating motor driver 68 controls the ink circulating motor 69 that drives the circulating pumps and the opening and closing valve, stops the ink circulation during recording, and finishes the main body operation.

The ejection recovery control of this embodiment is characterized by the control of preliminary ejection in step S16. First, how ink is circulated in a recording head will be described.

Figure 10A:
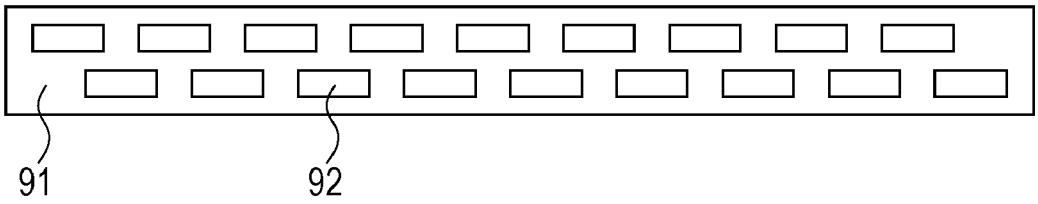
FIGS. 10A to 10C are plan views for illustrating an ink passage of a recording head.
Figure 10B:
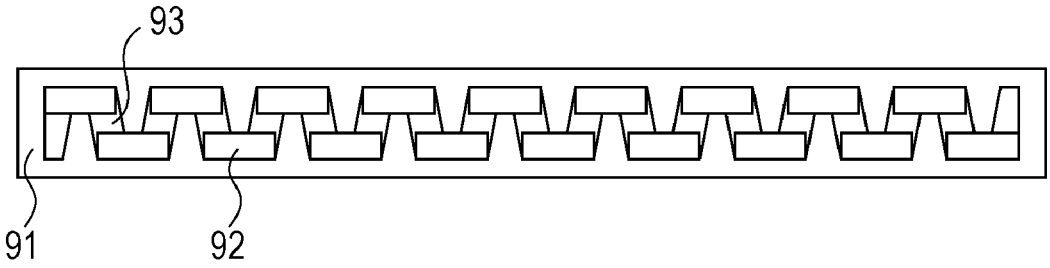

FIG. 10A is a see-through plan view of a base plate 91 of a recording head 2 and shows the arrangement of chips 92 attached to the base plate 91. Each chip 92 has nozzles formed therein and these nozzles eject the same color of ink. In the base plate 91 is formed a passage for circulating ink. FIG. 10B shows an ink passage 93 in the base plate 91. Ink circulation diffuses thickened ink in the recording head during recording.

Figure 10C:
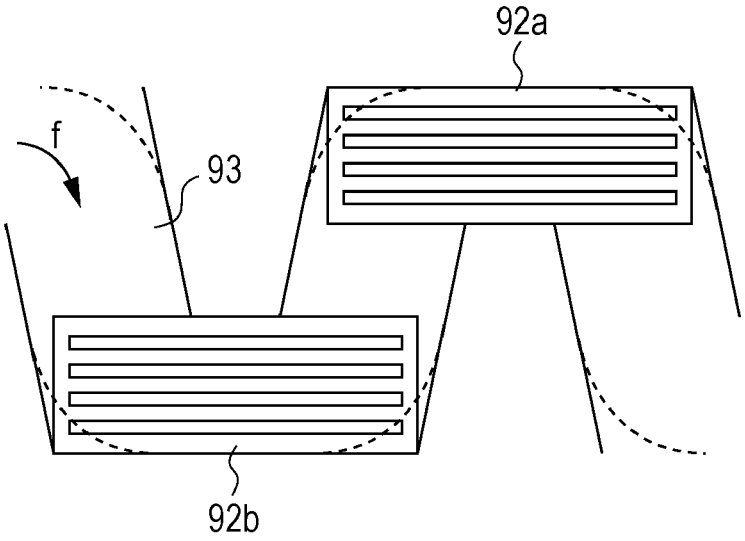

FIG. 10C is an enlarged view of the ink passage in the base plate 91. In the figure are shown two chips 92*a* and 92*b*. The ink passage 93 passes through these chips. In the passage, ink flows in the direction of arrow f. Although the ink passage 93 takes into account the width of the chips, the actual flow of ink is not uniform, and ink flows mainly inside the region shown by dotted line. At bends of the ink circulation passage, ink on the outer side of the passage is hard to cause to flow. Therefore, compared to the ink in the middle of the ink circulation passage, the ink on the outer side of the ink circulation passage is poorly diffused.

So, in this embodiment, at the time of preliminary ejection of step S16, nozzles in the nozzle rows provided in each chip are divided into nozzle groups, and the number of preliminary ink ejections (the number of dots) is varied with each nozzle group. That is to say, in this embodiment, the number of preliminary ejections of nozzles located at a position where ink is hard to cause to flow and hard to diffuse is larger than the number of preliminary ejections of nozzles located at a position where ink is easy to cause to flow and easy to diffuse.

Figures 11A, 11B, 11C:
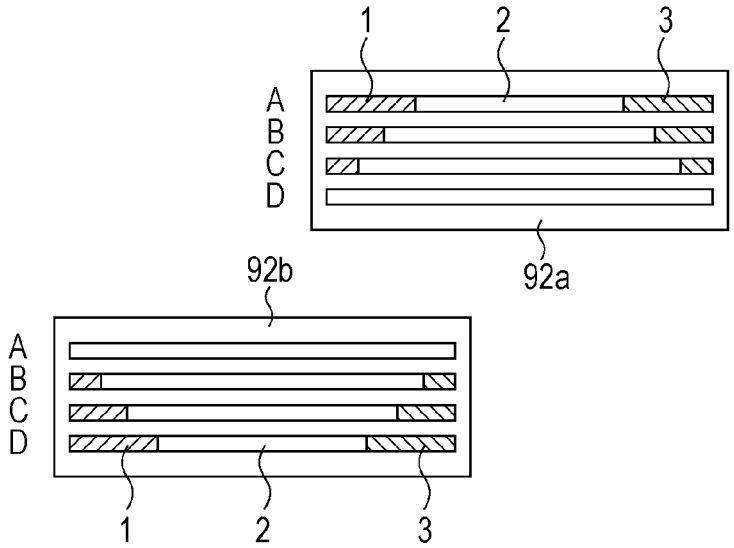
FIGS. 11A to 11C show the number of preliminary ejections of each nozzle group.

FIG. 11A illustrates a method for dividing a plurality of nozzle rows in a chip into a plurality of nozzle groups. In this figure, chips 92*a* and 92*b* correspond to the chips 92*a* and 92*b* of FIG. 10C, and nozzle rows A, B, C, and D provided in each chip are divided into nozzle groups 1, 2, and 3. FIG. 11B shows an example of division into nozzle groups in the chip 92*a*. 1024 nozzles in each of the nozzle rows A, B, C, and D are assigned seg numbers seg 0 to seg 1023 in order from left of FIG. 11A. In the nozzle row A of the chip 92*a*, seg 0 to seg 383 constitute nozzle group 1, seg 384 to seg 639 constitute nozzle group 2, and seg 640 to seg 1023 constitute nozzle group 3. The nozzle rows B and C are also divided into nozzle groups 1 to 3 as shown in FIG. 11B, whereas all the nozzles in the nozzle row D constitute nozzle group 2.

Thus, nozzles that are located on the outer side of each bend of the ink circulation passage and in which ink is poorly diffused belong to nozzle group 1 or 3, and nozzles in which ink is well diffused belong to nozzle group 2. Each nozzle in nozzle groups 1 and 3 in which ink is poorly diffused performs 4000 preliminary ejections (ejects 4000 dots), and each nozzle in nozzle group 2 in which ink is well diffused performs 1000 preliminary ejections.

On the other hand, in the chip 92*b*, as shown in FIG. 11C, all the nozzles in the nozzle row A constitute nozzle group 2, and the nozzle rows B to D are divided into nozzle groups 1 to 3. Each nozzle in nozzle groups 1 and 3 in which ink is poorly diffused performs 4000 preliminary ejections, and each nozzle in nozzle group 2 in which ink is well diffused performs 1000 preliminary ejections.

The data of the number of preliminary ejections of each nozzle group shown in FIGS. 11B and 11C are stored in the ROM of the memory unit 63. Referencing the data, the CPU 62 causes each nozzle group to perform the predetermined number of preliminary ejections. Because the number of preliminary ejections is set according to the state of diffusion of ink in each nozzle, thickened ink at each bend of the ink circulation passage can be discharged without wasting ink.

As described above, in this embodiment, the number of preliminary ejections of the nozzle groups located on the outer side of each bend of the ink circulation passage is larger than the number of preliminary ejections of the nozzle group located in the middle of each bend of the ink circulation passage. At each bend, compared to the ink in the middle, the ink on the outer side of the ink circulation passage is poorly diffused. In this embodiment, sufficient preliminary ejection can be performed from the nozzles located on the outer side of the circulation passage without significantly increasing the total number of preliminary ejections.

From another viewpoint, this embodiment can be viewed as follows. In this embodiment, as shown in FIG. 10A, chips 92*a* and 92*b* in which a plurality of nozzle rows are arranged are staggered in a predetermined direction (the horizontal direction of the figure, the nozzle arrangement direction) and a direction perpendicular thereto (the vertical direction of the figure). An ink passage is provided for the chips and connects a first end of the chip 92*a* corresponding to a first chip and a second end of the chip 92*b* corresponding to a second chip. Ink in the ink passage flows in one direction, and thereby ink in the recording head circulates. In such a configuration, as a result, ends in the predetermined direction of the plurality of nozzle rows of the chips 92*a* and 92*b* correspond to bends of the ink passage. So, in the above embodiment, the number of preliminary ejections of the nozzle group (nozzle group 1) including the nozzle at the first end of a nozzle row and the nozzle group (nozzle group 3) including the nozzle at the second end are larger than the number of preliminary ejections of the other nozzle group (nozzle group 2).

The nozzle rows A to D are divided into nozzle groups in different manner. The number of nozzles included in each nozzle group varies with each nozzle row. However, all the nozzle rows A to D may be divided into nozzle groups in the same manner. For example, in all the nozzle rows A to D, nozzles from seg 0 to seg 383 constitute nozzle group 1, nozzles from seg 384 to seg 639 constitute nozzle group 2, and nozzles from seg 640 to seg 1023 constitute nozzle group 3. Although the number of preliminary ejections is larger than that in the above example, every nozzle row is divided into nozzle groups in the same manner, and therefore the control of preliminary ejection can be simplified.

In this embodiment, each chip is provided with a plurality of nozzle rows. However, each chip may be provided with a single nozzle row. Nozzle rows do not necessarily have to be provided in separate chips. A plurality of nozzle rows may be provided in a single chip, and of the nozzle rows, a first nozzle row and a second nozzle row may be staggered in a predetermined direction and a direction perpendicular thereto. In any of these cases, the number of preliminary ejections of the nozzle groups at the ends of a nozzle row is larger than the number of preliminary ejections of the other middle nozzle group.

Second Embodiment

This embodiment is characterized in that the recording time that is the time when the recording heads are exposed to the atmosphere is measured, and the number of preliminary ejections is varied according to the measured time. In the first embodiment, independently of the recording time, 4000 preliminary ejections are performed from nozzle groups 1 and 3, and 1000 preliminary ejections are performed from nozzle group 2. In this embodiment, the number of preliminary ejections is varied according to the recording time. The characteristic configuration of the second embodiment will be described. The other configurations are the same as those of the first embodiment, so the description thereof will be omitted.

Figure 12:
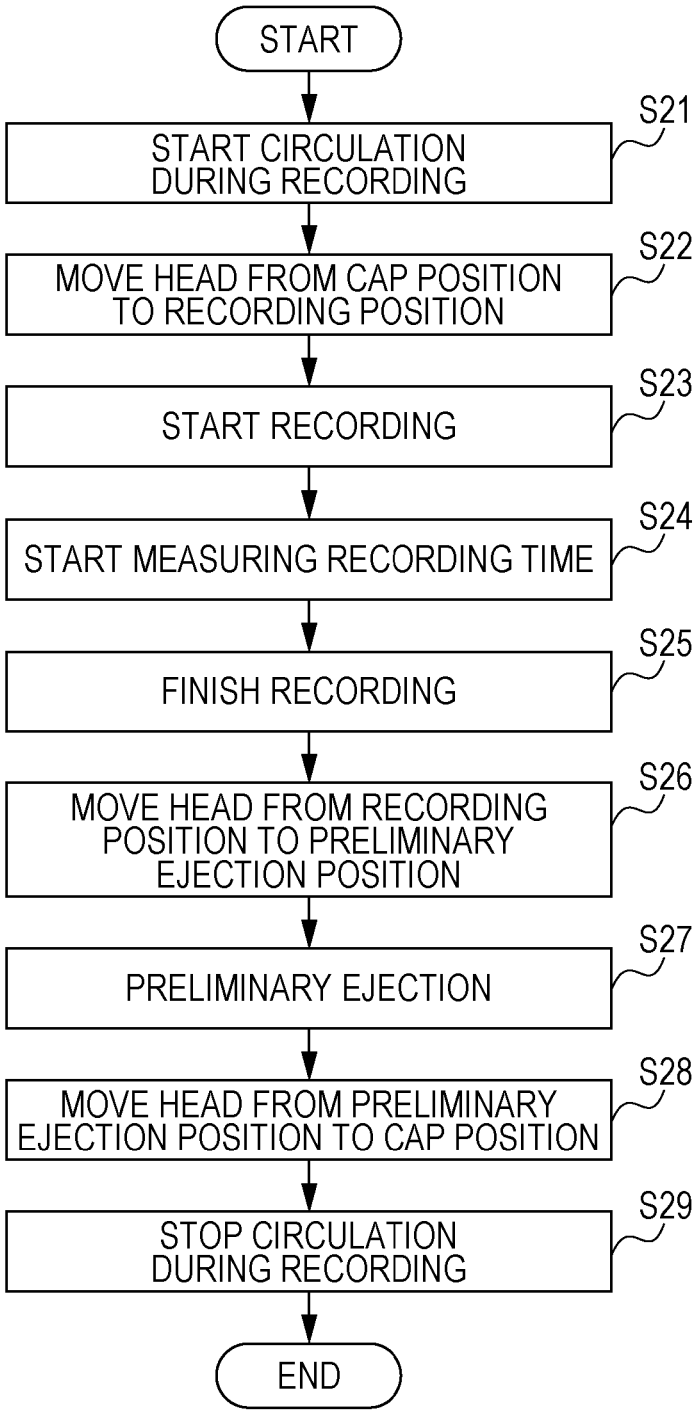
FIG. 12 is a flowchart showing a method for recovering ejection according to a second embodiment.

FIG. 12 is a flowchart showing the outline of a method for recovering ejection in this embodiment. First, in step S21, the ink circulating motor driver 68 controls the ink circulating motor 69 that drives the circulating pumps and the opening and closing valve, and starts the ink circulation in the recording heads 2 during recording. The circulation during recording diffuses thickened ink in the recording heads 2 and prevents the temperature increase of the recording heads 2 due to ejection. In step S22, in order to receive a recording command from an operator and to start recording, the carriage motor driver 64 drives the carriage motor 65 and moves the recording heads 2 from the cap position to the recording position. In step S23, the conveying motor driver 66 controls the conveying motor 67 that conveys the recording medium 3, and the recording medium 3 is conveyed. By a command from the CPU 62, the recording heads 2 are driven and controlled, and image recording is started. The recording heads 2 are 12 inches in width, and the recording medium 3 is 6 inches in width in this embodiment.

When the image recording is started in step S23, the CPU 62 starts a timer provided in the apparatus and starts measuring the recording time in step S24. In step S25, the conveying motor driver 66 controls the conveying motor 67 that conveys the recording medium 3, and finishes the conveying of the recording medium 3. By a command from the CPU 62, the recording heads 2 finishes the image recording.

During image recording, preliminary ejection is performed between image recording operations on the recording medium 3 (roll paper). However, nozzles located outside the edges of the recording medium 3 cannot perform preliminary ejection onto the recording medium 3. Such nozzles do not eject ink for a long time, and therefore ink thickened due to water evaporation occupies not only the mouths of the nozzles but also liquid chambers at the backs of the nozzles.

Next, in step S26, the carriage motor driver 64 drives the carriage motor 65 and moves the recording heads 2 after finishing recording from the recording position to the preliminary ejection position. The cap unit 46 is moved to under the recording heads 2 so that the recording heads 2 can perform preliminary ejection. In step S27, by a command from the CPU 62, the recording heads 2 are driven and controlled, and preliminary ejection is performed into the caps. The nozzle rows of each chip are divided into the nozzle groups shown in FIGS. 11A to 11C, and each nozzle group performs a predetermined number of preliminary ejections.

In this embodiment, the number of preliminary ejections of each nozzle group is varied according to the recording time. FIG. 13A shows the relationship between the recording time and the numbers of preliminary ejections of nozzle groups 1 to 3. As shown in the figure, in this embodiment, the number of preliminary ejections of the nozzle groups in which ink is poorly diffused (nozzle groups 1 and 3) is larger than the number of preliminary ejections of the nozzle group in which ink is well diffused (nozzle group 2). The longer the measured recording time, the larger the number of preliminary ejections. However, when the recording time is within five minutes, the numbers of preliminary ejections of nozzle groups 1 to 3 are all set to 1000. The reason is that, when the recording time is short, ink in every nozzle is not thickened, and therefore a small number of (1000) preliminary ejections are enough even for nozzles that are low in diffusion efficiency of ink circulation. Because nozzle group 2 is high in diffusion efficiency of ink circulation, nozzle group 2 need not perform a large number of preliminary ejections even when the recording time is long, and performs a constant number of preliminary ejections independently of the recording time. Of course, when the recording time is within five minutes, nozzle groups 1 and 3 and nozzle group 2 may perform different numbers of preliminary ejections, and the number of preliminary ejections of nozzle group 2 may increase with increase in recording time. The data of the number of preliminary ejections of each nozzle group according to the recording time shown in FIG. 13A are stored in the ROM of the memory unit 63. In step S27, referencing the data, the CPU 62 causes each nozzle group to perform the predetermined number of preliminary ejections.

When the recording time is short, the amount of thickened ink in the nozzles is small, and therefore a small number of preliminary ejections are enough to recover the ejection performance of the recording heads 2.

After the preliminary ejection in step S27, in step S28, the carriage motor driver 64 drives the carriage motor 65 and moves the recording heads 2 from the preliminary ejection position to the cap position. In step S29, the ink circulating motor driver 68 controls the ink circulating motor 69 that drives the circulating pumps and the opening and closing valve, stops the ink circulation during recording, and finishes the main body operation.

As described above, in this embodiment, by measuring the recording time that is the time when the recording heads are exposed to the atmosphere, and varying the number of preliminary ejections according to the measured time, a number of preliminary ejections according to the degree of thickening of ink in the nozzles can be performed.

Other Embodiments

In the above embodiments, nozzle rows are divided into two types: nozzle groups in which ink is poorly dispersed (nozzle groups 1 and 3); and a nozzle group in which ink is well dispersed (nozzle group 2). However, nozzle rows may be divided into three or more types of groups from the outer side to the middle of the circulation passage. In that case, the ink diffusion efficiency decreases with distance from the middle of the circulation passage, and therefore the number of preliminary ink ejections increases with distance from the middle of the circulation passage.

In step S16 or S27, preliminary ejection is performed from the nozzles outside the recording medium. However, preliminary ejection may also be performed from the nozzles located inside the edges of the recording medium, that is, the nozzles that perform recording and preliminary ejection onto the recording medium. In the case of this preliminary ejection of the inside nozzles, nozzle rows are also divided into a plurality of nozzle groups, and the number of preliminary ejections is varied with each nozzle group. However, ink in nozzles that perform recording on the recording medium thickens more slowly than ink in nozzles that are located outside the recording medium and do not perform recording. Therefore, nozzles that perform recording and preliminary ejection onto the recording medium perform a smaller number of preliminary ejections than nozzles that do not perform recording, for example, half the number of preliminary ejections shown in FIGS. 11B and 11C.

In the above description, the number of preliminary ejections of the nozzle groups in which ink is poorly diffused is larger than the number of preliminary ejections of the nozzle group in which ink is well diffused, and therefore thickened ink on the outer side of each bend of the ink circulation passage is efficiently discharged. However, the method for efficiently discharging thickened ink on the outer side of each bend of the ink circulation passage is not limited to varying the number of preliminary ejections. For example, by varying the drive frequency with each nozzle group, thickened ink can also be efficiently discharged. FIG. 13B shows the drive frequencies of nozzle group 1 to 3. As shown, the drive frequency of each of nozzle groups 1 and 3 in which ink is poorly diffused is higher than the drive frequency of nozzle group 2 in which ink is well diffused, and therefore thickened ink can be efficiently discharged. The reason is that the higher the drive frequency during preliminary ejection, the more frequently refilling of ink is repeated in the nozzles, and this promotes the diffusion of ink in the nozzles and at the back of the nozzles. The drive frequency of each nozzle group may be varied according to the recording time as shown in FIG. 13C.

Figures 14A, 14B, 14C:
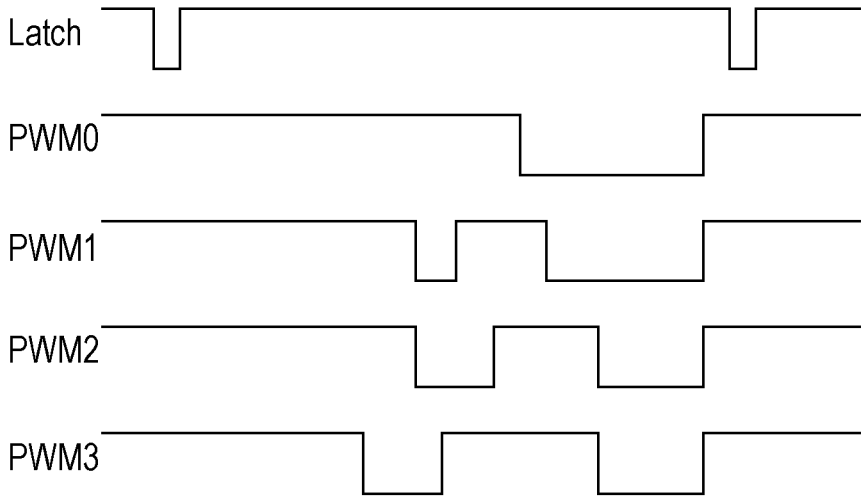
FIGS. 14A to 14C illustrate the drive pulse of each nozzle group.

As another method for efficiently discharging thickened ink, the drive pulse in preliminary ejection may be varied with each nozzle group. FIG. 14A shows the relationship between the drive pulses (PWM0 and PWM3) of nozzle groups 1 to 3. FIG. 14B shows an example in which the drive pulse of each nozzle group is varied (PWM0 to PWM3) according to the recording time. FIG. 14C shows the drive waveforms of drive pulses PWM0 to PWM3, and PWM0 to PWM3 have such waveforms that the amount of ejection increases in this order.

Any one of the number of preliminary ejections, the drive frequency, and the drive pulse or a combination thereof may be varied with each nozzle group.

The above-described recording apparatus is a full-line type recording apparatus that conveys a recording medium and performs recording using recording heads. The recording heads each have nozzle rows having a width equal to or larger than the maximum paper width and are fixed to predetermined positions. However, the present invention is not limited to this configuration and can be widely applied to recording apparatuses that perform recording using a recording head. The present invention can be applied, for example, to a serial-type inkjet recording apparatus that records an image by repeating main scanning and subscanning. In the main scanning, a carriage is moved in a scanning direction and ink is ejected from a recording head. In the subscanning, a recording medium is conveyed in a conveying direction a distance corresponding to the recording width of the recording head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-042350 filed Feb. 26, 2010, which is hereby incorporated by reference herein in its entirety.

What is claimed is:

1. An inkjet recording apparatus that records an image on a recording medium using a recording head having a plurality of nozzle rows in which nozzles for ejecting ink are arranged, the apparatus comprising:

an ink passage for supplying ink to the plurality of nozzle rows;

a circulation unit configured to circulate ink in the ink passage; and a preliminary ejection unit configured to preliminarily eject ink from the plurality of nozzle rows, wherein the preliminary ejection unit preliminarily ejects ink from the plurality of nozzle rows in such a manner that the amount of ink preliminarily ejected from a nozzle group located on the outer side of a bend of the ink passage is larger than the amount of ink preliminarily ejected from a nozzle group located in the middle of the bend of the ink passage.

2. An inkjet recording apparatus that records an image on a recording medium using a recording head having a first nozzle row and a second nozzle row in which nozzles for ejecting ink are arranged in a predetermined direction, the first nozzle row and the second nozzle row being staggered in the predetermined direction and a direction perpendicular to the predetermined direction, the apparatus comprising:

a circulation unit configured to cause ink to flow in one direction of an ink passage corresponding to the first nozzle row and the second nozzle row and connecting a first end in the predetermined direction of the first nozzle row and a second end in the predetermined direction of the second nozzle row and to thereby circulate ink supplied to the nozzles; and a preliminary ejection unit configured to preliminarily eject ink from the first nozzle row and the second nozzle row, wherein the preliminary ejection unit preliminarily ejects ink from the first nozzle row and the second nozzle row in such a manner that the amount of ink preliminarily ejected from a nozzle group including at least a nozzle at the first end and the amount of ink preliminarily ejected from a nozzle group including at least a nozzle at the second end are each larger than the amount of ink preliminarily ejected from the other nozzle group.

3. The inkjet recording apparatus according to claim 2, wherein the first nozzle row and the second nozzle row are formed in different chips.

4. The inkjet recording apparatus according to claim 2, wherein of the plurality of nozzle rows of the first chip, the nozzle row on the outer side in the perpendicular direction is larger in the number of nozzles included in the nozzle group including at least the nozzle at the first end and the number of nozzles included in the nozzle group including at least the nozzle at the second end; and of the plurality of nozzle rows of the second chip, the nozzle row on the outer side in the perpendicular direction is larger in the number of nozzles included in the nozzle group including at least the nozzle at the first end and the number of nozzles included in the nozzle group including at least the nozzle at the second end.

5. The inkjet recording apparatus according to claim 2, further comprising a time measuring unit configured to measure the time when an image is recorded on a recording medium, wherein the preliminary ejection unit varies the amount of ink of the preliminary ejection on the basis of the time measured by the time measuring unit.

6. The inkjet recording apparatus according to claim 2, wherein the preliminary ejection unit preliminarily ejects ink from the nozzles of the first nozzle row and the second nozzle row located outside the edges of the recording medium.

7. The inkjet recording apparatus according to claim 2, wherein the preliminary ejection unit varies the amount of ink to be preliminarily ejected by varying the number of preliminary ejections.

8. The inkjet recording apparatus according to claim 2, wherein the preliminary ejection unit varies the amount of ink to be preliminarily ejected by varying the drive pulse of ink to be preliminarily ejected.

9. A method for controlling an inkjet recording apparatus that records an image on a recording medium using a recording head having a first nozzle row and a second nozzle row in which nozzles for ejecting ink are arranged in a predetermined direction, the first nozzle row and the second nozzle row being staggered in the predetermined direction and a direction perpendicular to the predetermined direction, the method comprising:

a circulation step of causing ink to flow in one direction of an ink passage corresponding to the first nozzle row and the second nozzle row and connecting a first end in the predetermined direction of the first nozzle row and a second end in the predetermined direction of the second nozzle row and thereby circulating ink supplied to the nozzles; and a preliminary ejection step of preliminarily ejecting ink from the first nozzle row and the second nozzle row, wherein in the preliminary ejection step, ink is preliminarily ejected from the first nozzle row and the second nozzle row in such a manner that the amount of ink preliminarily ejected from a nozzle group including at least a nozzle at the first end and the amount of ink preliminarily ejected from a nozzle group including at least a nozzle at the second end are each larger than the amount of ink preliminarily ejected from the other nozzle group.

10. The method according to claim 9, wherein the first nozzle row and the second nozzle row are formed in different chips.

11. The method according to claim 9, wherein of the plurality of nozzle rows of the first chip, the nozzle row on the outer side in the perpendicular direction is larger in the number of nozzles included in the nozzle group including at least the nozzle at the first end and the number of nozzles included in the nozzle group including at least the nozzle at the second end; and of the plurality of nozzle rows of the second chip, the nozzle row on the outer side in the perpendicular direction is larger in the number of nozzles included in the nozzle group including at least the nozzle at the first end and the number of nozzles included in the nozzle group including at least the nozzle at the second end.

12. The method according to claim 9, further comprising a time measuring step of measuring the time when an image is recorded on a recording medium, wherein in the preliminary ejection step, the amount of ink of the preliminary ejection is varied on the basis of the time measured in the time measuring step.

13. The method according to claim 9, wherein in the preliminary ejection step, ink is preliminarily ejected from the nozzles of the first nozzle row and the second nozzle row located outside the edges of the recording medium.

14. The method according to claim 9, wherein in the preliminary ejection step, the amount of ink to be preliminarily ejected is varied by varying the number of preliminary ejections.

15. The method according to claim 9, wherein in the preliminary ejection step, the amount of ink to be preliminarily ejected is varied by varying the drive pulse of ink to be preliminarily ejected.

* * * * *